US010672405B2

(12) United States Patent
Hines et al.

(10) Patent No.: US 10,672,405 B2
(45) Date of Patent: Jun. 2, 2020

(54) OBJECTIVE QUALITY METRICS FOR AMBISONIC SPATIAL AUDIO

(71) Applicant: GOOGLE LLC, Mountain View, CA (US)

(72) Inventors: Andrew Hines, Dublin (IE); Jan Skoglund, San Francisco, CA (US); Andrew Allen, San Jose, CA (US); Miroslaw Narbutt, Dublin (IE)

(73) Assignee: GOOGLE LLC, Mountain View, CA (US)

( * ) Notice: Subject to any disclaimer, the term of this patent is extended or adjusted under 35 U.S.C. 154(b) by 81 days.

(21) Appl. No.: 15/973,287

(22) Filed: May 7, 2018

(65) Prior Publication Data

US 2019/0341060 A1 Nov. 7, 2019

(51) Int. Cl.

| | |
|---|---|
| ***G10L 19/00*** | (2013.01) |
| ***G10L 19/008*** | (2013.01) |
| ***G10L 19/022*** | (2013.01) |
| ***G10L 19/16*** | (2013.01) |

(52) U.S. Cl.

CPC ..... *G10L 19/008* (2013.01); *G10L 19/022* (2013.01); *G10L 19/167* (2013.01)

(58) Field of Classification Search

CPC .. H04S 2420/11; H04S 3/008; H04S 2400/01; H04S 2400/11; H04S 2420/01; H04S 2420/13; H04S 3/002; G10L 19/008; G10L 19/20; G10L 19/02; G10L 19/022; G10L 21/0232; G10L 21/0272; G10L 25/69; A61B 3/1015

See application file for complete search history.

(56) References Cited

U.S. PATENT DOCUMENTS

| | | | | |
|---|---|---|---|---|
| 9,397,771 | B2 * | 7/2016 | Jax | H04H 20/89 |
| 2009/0238370 | A1 * | 9/2009 | Rumsey | H04R 29/00 381/58 |
| 2009/0238371 | A1 * | 9/2009 | Rumsey | H04R 29/001 381/58 |

OTHER PUBLICATIONS

A. Hines, J. Skoglund, A. Kokaram and N. Harte, "ViSQOL: The Virtual Speech Quality Objective Listener," IWAENC 2012; International Workshop on Acoustic Signal Enhancement, Aachen, Germany, 2012, pp. 1-4.*

Hellerud, E., Burnett, I., Solvang, A., & Svensson, U. P. (2008). Encoding higher order ambisonics with AAC.*

(Continued)

*Primary Examiner* — Edgar X Guerra-Erazo

(74) *Attorney, Agent, or Firm* — Brake Hughes Bellermann LLP

(57) ABSTRACT

A computing device includes a processor and a memory. The processor is configured to generate spectrograms, for example, using short-time Fourier transform, for a plurality of channels of reference and test ambisonic signals. In some implementations, the test ambisonic signal may be generated by decoding an encoded version of the reference ambisonic signal. The processor is further configured to compare, for each of the plurality of channels of a reference ambisonic signal, at least a patch associated with a channel of the reference ambisonic signal with at least a corresponding patch of a corresponding channel of the test ambisonic signal and determine a localization accuracy of the test ambisonic signal based on the comparison. In some implementations, the comparing may be based on phaseograms of the reference and test ambisonic signals.

20 Claims, 6 Drawing Sheets

(56) References Cited

OTHER PUBLICATIONS

Brettle et al., "Open-Source Spatial Audio Compression for VR Content", in SMPTE 2016 Annual Technical Conference and Exhibition, Oct. 2016, pp. 1-9.
Gerzon, M. A., "Ambisonics in Multichannel Broadcasting and Video", Journal of the Audio Engineering Society, vol. 33, No. 11, 1985, pp. 859-871.
Herre et al., "MPEG-H 3D Audio—The New Standard for Coding of Immersive Spatial Audio", IEEE Journal of Selected Topics in Signal Processing, vol. 9, No. 5, Aug. 2015, pp. 770-779.
Hines et al., "Speech Intelligibility Prediction Using a Neurogram Similarity Index Measure", Speech Communication, vol. 54, No. 2, 2012, pp. 306-320.
Hines et al., "ViSQOL: An Objective Speech Quality Model", EURASIP Journal on Audio, Speech, and Music Processing, vol. 2015, No. 1, 2015, 18 pages.
Hines et al., "ViSQOLAudio: An Objective Audio Quality Metric for Low Bitrate Codecs", The Journal of the Acoustical Society of America, vol. 137, No. 6,, 2015, pp. EL449-EL455.
Itu, "Methods for Subjective Determination of Transmission Quality", ITU-R Rec. P.800, Aug. 1996, 37 pages.
Itu, "Methods for the Subjective Assessment of Small Impairments in Audio Systems", ITU-T Rec. BS.1116-3, Feb. 2015, 32 pages.
Itu, "Perceptual Objective Listening Quality Assessment", ITU-R Rec. P.863, Sep. 2014, 82 pages.
Itu, "Spatial Audio Meetings Quality Evaluation", ITU-T Rec. P.1310, Mar. 2017, 30 pages.
Itu, "Subjective Assessment of Sound Quality", ITU-R Rec. BS.1534-3, Oct. 2015.
Kämpf et al., "Standardization of PEAQ-MC: Extension of ITU-R BS.1387-1 to Multichannel Audio", Audio Engineering Society Conference: 40th International Conference: Spatial Audio: Sense the Sound of Space, Oct. 2010.
Narbutt et al., "Streaming VR for Immersion: Quality Aspects of Compressed Spatial Audio", 23rd International Conference on Virtual System Multimedia (VSMM), Oct. 2017, 7 pages.
Park et al., "A Model of Sound Localisation Applied to the Evaluation of Systems for Stereophony", Acta Acustica United With Acustica, vol. 94, 2008, pp. 825-839.
Rayleigh, L., "Xii. On Our Perception of Sound Direction", The London, Edinburgh, and Dublin Philosophical Magazine and Journal of Science, vol. 13, No. 74, 1907, pp. 214-232.
Skoglund et al., "IETF Internet-Draft: Ambisonics in an Ogg Opus Container", Internet-Draft, available online at <https://tools.ietf.org/html/draft-ietf-codec-ambisonics-02>, Mar. 27, 2017, 8 pages.
Thiede et al., "PEAQ—The ITU Standard for Objective Measurement of Perceived Audio Quality", Journal of the Audio Engineering Society, vol. 48, No. 1/2, Jan./Feb. 2000, pp. 3-29.
Valin et al., "Definition of the Opus Audio Codec", Internet Engineering Task Force (IETF), Sep. 2012, 326 pages.
Zacharov et al., "Next Generation Audio System Assessment Using the Multiple Stimulus Ideal Profile Method", Eighth International Conference on Quality of Multimedia Experience (QoMEX), Jun. 6-8, 2016.
Akhtar, Zahid et al., "Audio-Visual Multimedia Quality Assessment: A Comprehensive Survey", IEEE Access, vol. 5, pp. 21090-21117, Oct. 25, 2017, XP011672104.
Cheng, Bin et al., "A Spatial Squeezing Approach to Ambisonic Audio Compression", IEEE International Conference on Acoustics, Speech and Signal Processing, pp. 369-372, Mar. 31, 2008, XP031250565.
International Search Report and Written Opinion for International Application No. PCT/US2019/030884, dated Jul. 4, 2019, 17 pages.
Narbutt, Miroslaw et al., "AMBIQUAL—a full reference objective quality metric for ambisonic spatial audio", 2018 Tenth International Conference on Quality of Multimedia Experience (QOMEX), pp. 1-6, May 29, 2018, XP033402148.
Sloan, Colm et al., "Objective Assessment of Perceptual Audio Quality Using ViSQOLAudio", IEEE Transactions on Broadcasting, vol. 63, No. 4, pp. 693-705, Dec. 2017, XP011674330.

* cited by examiner

600

OBJECTIVE QUALITY METRICS FOR AMBISONIC SPATIAL AUDIO

FIELD

The present disclosure generally relates to streaming of spatial audio, and specifically, to streaming of ambisonic spatial audio.

BACKGROUND

Streaming of spatial audio over networks requires efficient encoding techniques to compress raw audio content without compromising users' quality of experience (QoE). However, objective quality metrics to measure users' perceived quality and spatial localization accuracy are not currently available.

SUMMARY

In one aspect, a computing device includes a processor and a memory. The processor is configured to generate spectrograms, for example, using short-time Fourier transform, for a plurality of channels of reference and test ambisonic signals. In some implementations, the test ambisonic signal may be generated by decoding an encoded version of the reference ambisonic signal. The processor is further configured to compare, for each of the plurality of channels of a reference ambisonic signal, at least a patch associated with a channel of the reference ambisonic signal with at least a corresponding patch of a corresponding channel of the test ambisonic signal and determine a localization accuracy of the test ambisonic signal based on the comparison. In some implementations, the comparing may be based on phaseograms of the reference and test ambisonic signals.

BRIEF DESCRIPTION OF THE DRAWINGS

Example implementations will become more fully understood from the detailed description given herein below and the accompanying drawings, wherein like elements are represented by like reference numerals, which are given by way of illustration only and thus are not limiting of the example implementations and wherein.

Figure 1:
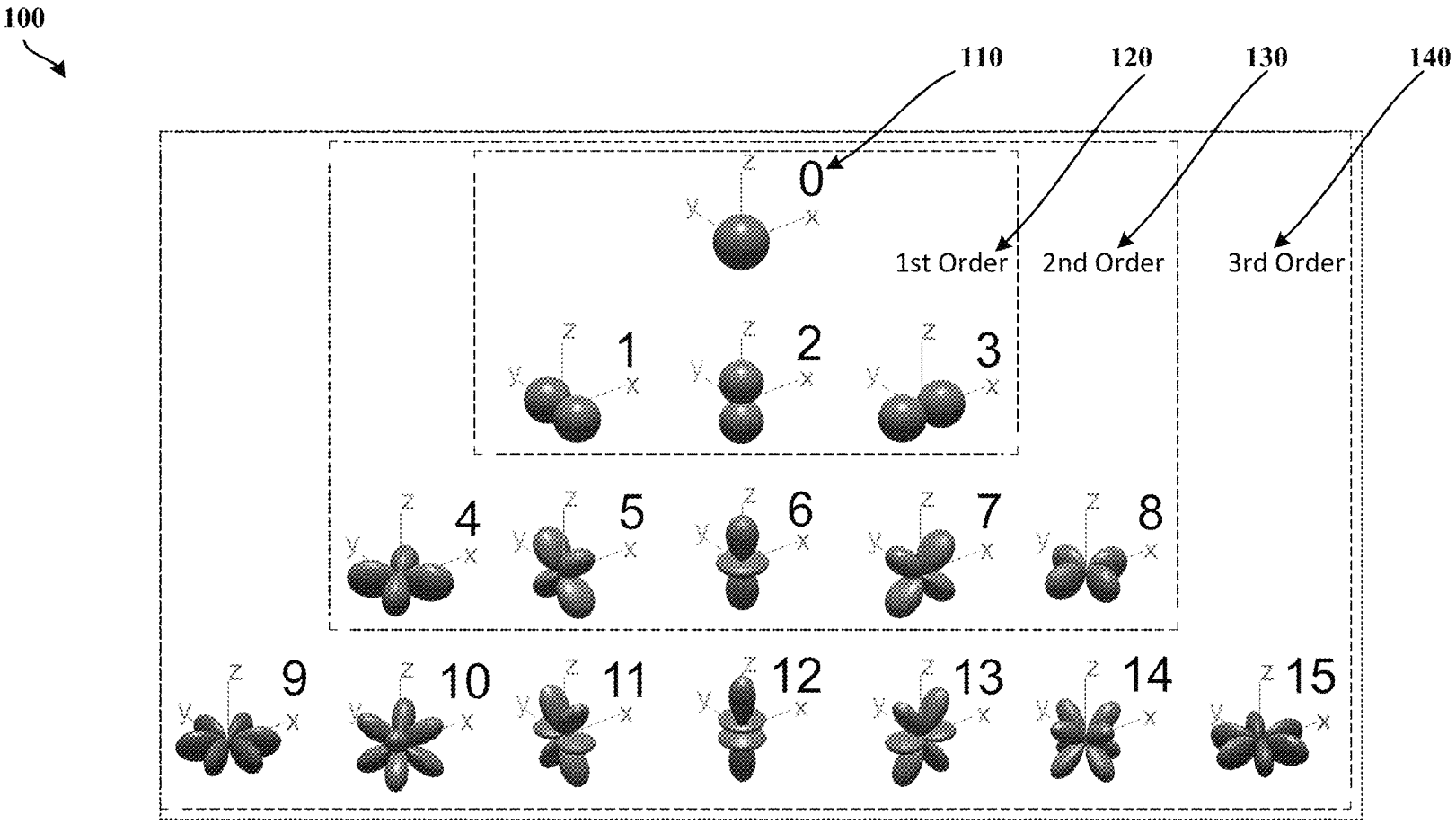
FIG. 1 illustrates spherical harmonics of a third order ambisonics stream, according to at least one example implementation.

It should be noted that these Figures are intended to illustrate the general characteristics of methods, structure, or materials utilized in certain example implementations and to supplement the written description provided below. These drawings are not, however, to scale and may not precisely reflect the precise structural or performance characteristics of any given implementation, and should not be interpreted as defining or limiting the range of values or properties encompassed by example implementation. The use of similar or identical reference numbers in the various drawings is intended to indicate the presence of a similar or identical element or feature.

DETAILED DESCRIPTION

Perceptual Evaluation of Speech Quality (PESQ) and Perceptual Objective Listening Quality Assessment (POLQA) are full-reference measures, described in International Telecommunication Union (ITU) standards, to predict speech quality by comparing a reference signal to a received (or degraded) signal. Neurogram similarity index measure (NSIM) is a simplified version of structural similarity index measure (SSIM) for speech signal comparison with factors (e.g., luminance, structure, etc.) that give a weighted adjustment to the similarity measure that looks at the intensity (luminance), and cross-correlation (structure) between a given pixel and those that surround it versus the reference image. NSIM between two spectrograms, e.g., a reference spectrogram, r, and a degraded spectrogram, d, may be defined with a weighted function of intensity, I, contrast, c, and structure, s, as shown in the following equation, $$Q(r, d) = l(r, d) \cdot s(r, d) = \frac{2\mu_r\mu_d + C_1}{\mu_r^2 + \mu_d^2 + C_1} \cdot \frac{\sigma_{rd} + C_3}{\sigma_r\sigma_d + C_3},$$

each component containing constant values $C_1$=0.01 L and $C_2$=$C_3$=(0.03 L)$^2$, where L is intensity range of the reference spectrogram (for instance, to avoid instabilities at boundary conditions, for example, where μ2r+μ2dμr2+μd2 is close to zero). In some implementations, for the purposes of neurogram comparisons for speech intelligibility estimation, the optimal window size may be a 3×3 pixel square covering three frequency bands and a 12.8-ms time window.

Virtual Speech Quality Objective Listener (ViSQOL) is a signal-based, full-reference, intrusive metric that models human speech quality perception using a spectro-temporal measure of similarity between a reference and a test signal. ViSQOL also works with Voice over Internet Protocol (VoIP) transmissions (e.g., streaming audio), which may encounter quality issues due to the nature of VoIP. ViSQOL provides a useful alternative to other metrics, for example, POLQA, in predicting speech quality in VoIP transmissions or streaming audio.

ViSQOLAudio (V) is a full reference objective metric for measuring audio quality. It is based on using NSIM, a similarity measure that compares the similarity of signals by aligning and evaluating the similarity across time and frequency bands using a spectrogram-based comparison. ViSQOLAudio calculates magnitudes of the reference and test spectrograms using a 32-band Gammatone filter bank (e.g., 50 Hz-20 KHz) to compare their similarity. ViSQOLAudio may also pre-process the test signal with time alignment and perform level adjustments to match timing and power characteristics of the reference signal. After pre-preprocessing, the signals may be compared with the NSIM similarity metric. ViSQOL is a model of human sensitivity to degradations in speech quality. It compares a reference signal with a degraded signal. The output is a prediction of speech quality perceived by an average individual. Moreover, ViSQOL and ViSQOL audio contain subsystems that map raw NSIM similarity score (e.g., 0-1 scale) to a human perceptual scale mean opinion score (MOS).

The delivery of spatial audio for streaming services over limited bandwidth networks using higher order ambisonics (HOA) has driven development of various compression (e.g., encoding) techniques. This requires quality assessment methodologies to measure the perceptual quality of experience (QoE) for spatial audio using compressed ambisonics. However, unlike existing metrics for speech or regular audio quality assessment, an assessment of QoE of spatial audio must take into account not only the effects of audio fidelity degradations but also whether compression has altered the perceived localization of sound source origins.

The present disclosure provides an objective audio quality metric that assesses Listening Quality (LQ) and/or Localization Accuracy (LA) of compressed B-format ambisonic signals. For example, in one implementation, the present disclosure describes an objective metric, referred to as AMBIQUAL that predicts users' quality of experience (QoE) by estimating Listening Quality and/or Localization Accuracy of an audio signal. The objective metric may be determined (e.g., computed) using ambisonics, which can simulate placement of auditory cues in a virtual 3D space to allow a person's ability to determine the virtual origin of a detected sound.

Ambisonics is a full sphere audio surround technique that can be based upon the decomposition of a 3D sound field into a number of spherical harmonics signals. In contrast to channel-based methods with fixed speakers' layouts (e.g. stereo, surround 5.1, surround 7.1, etc.), ambisonics contain a speaker-independent representation of a 3D sound field known as B-format, which can be decoded to any speaker layout. The B-format may be especially useful in Augmented Reality (AR) and Virtual Reality (VR) applications as the format offers good audio signal manipulation possibilities (e.g., rendering audio in real-time according to head movements). The complete spatial audio information can be encoded into an ambisonics stream containing a number of spherical harmonics signals and scaled to any desired spatial order.

The AMBIQUAL model builds on an adaptation of the ViSQOLAudio algorithm. The AMBIQUAL model predicts perceived quality and spatial localization accuracy by computing signal similarity directly from the B-format ambisonic audio streams. As with ViSQOLAudio, the AMBIQUAL model derives a spectro-temporal measure of similarity between a reference and test audio signal. AMBIQUAL derives Listening Quality and Localization Accuracy metrics directly from the B-format ambisonic audio channels unlike other existing methods that evaluate binaurally rendered signals. The AMBIQUAL model predicts a composite QoE for the spatial audio signal that is not focused on a particular listening direction or a given head related transfer function (HRTF) that is used in rendering the binaural signal.

In some implementations, for example, a computing device may generate spectrograms for each channel of reference and test signals. The reference and test signals may be higher order ambisonics (e.g., third order) and the computing device may create (or generate) patches from each of the spectrograms. For example, the computing device may create one more patches for each channel of the reference and test signals. A patch may be a short duration of the entire signal, for example, 0.5 second in duration, and may a defined as a portion of the reference or test signal. Once the patches are created, the computing device may compare patches of the reference signal with corresponding patches (e.g., patches of a corresponding channel and with the closest match) of the test signal. The comparison may be performed using NSIM based on comparing spectrograms, phaseograms, or a combination thereof) to generate aggregate similarity scores. In one implementation, for example, the computing device may determine the Listening Quality based on an aggregate score associated with an omni-directional channel (e.g., channel 0). In another implementation, for example, the computing device may determine Localization Accuracy based on a weighted sum of similarity scores between corresponding multi-directional channels (e.g., channels 1-15).

FIG. 1 illustrates spherical harmonics 100 of a third order ambisonics stream. The spherical harmonics illustrated in FIG. 1 are sorted by increasing ambisonic channel number (ACN) and aligned for symmetry. The relevant spherical harmonics functions that may provide the direct-dependent amplitudes of each of the ambisonics signals are defined below in Table I.

For example, as illustrated in FIG. 1, a first order ambisonics (1OA) audio 120 may be encoded into four spherical harmonics signals: an omni-directional component of order 0 (110) and three directional components of order 1 (120)–X (forward/backwards), Y (left/right), and Z (up/down). A second order ambisonics (2OA) audio 130 may be encoded into the omni-directional component of order 0 (110), the four directional components of order 1 (120), and five directional components of order 2 (130). A third order ambisonics (3OA) audio 140 may be encoded into the omni-directional component of order 0 (110), four directional components of order 1 (120), the five directional components of order 2 (130), and seven directional components of order 3 (140). An ambisonics stream (or signal) is said to be of order n when the ambisonics stream contains all the signals of orders 0 to n. Moreover, the corresponding directional spherical harmonics represent more complex polar patterns allowing more accurate source localization as ambisonics order increases. The use of higher order ambisonics (HOA) may improve Listening Quality and Localization accuracy (e.g., more directional spherical harmonics). However, higher amounts of processing resources may be needed to transform ambisonic multi-channel streams into a rendered soundscape. Therefore, streaming ambisonics (e.g., ambisonics data) over networks requires efficient encoding techniques to compress raw audio content in real time and without significantly compromising QoE.

In one implementation, omni-directional or multi-dimensional components of ambisonics may be referred to by ACNs, ambisonics of third order that may include 16 channels (of orders 0-3), as shown below in Table I. In addition, Table I has formulas for ambisonics expressing amplitudes as a function of Azimuth (a) and Elevation (e), in one example implementation.

TABLE I

| ACN | Order | Formula |
|---|---|---|
| 0 | 0 | 1 |
| 1 | 1 | sin(α)cos(e) |
| 2 | 1 | sin(e) |

TABLE I-continued

| ACN | Order | Formula |
|---|---|---|
| 3 | 1 | $\cos(\alpha)\cos(e)$ |
| 4 | 2 | $\frac{\sqrt{3}}{2}\sin(2\alpha)\cos^2(e)$ |
| 5 | 2 | $\frac{\sqrt{3}}{2}\sin(\alpha)\sin(2e)$ |
| 6 | 2 | $\frac{1}{2}(3\sin^2(e)-1)$ |
| 7 | 2 | $\frac{\sqrt{3}}{2}\cos(\alpha)\sin(2e)$ |
| 8 | 2 | $\frac{\sqrt{3}}{2}\cos(2\alpha)\cos^2(e)$ |
| 9 | 3 | $\sqrt{\frac{5}{8}}\sin(3\alpha)\cos^3(e)$ |
| 10 | 3 | $\frac{\sqrt{15}}{2}\sin(2\alpha)\sin(e)\cos^2(e)$ |
| 11 | 3 | $\sqrt{\frac{3}{8}}\sin(\alpha)\cos(e)(5\sin^2(e)-1)$ |
| 12 | 3 | $\frac{1}{2}\sin(e)(5\sin^2(e)-3)$ |
| 13 | 3 | $\sqrt{\frac{3}{8}}\cos(\alpha)\cos(e)(5\sin^2(e)-1)$ |
| 14 | 3 | $\frac{\sqrt{15}}{2}\cos(2\alpha)\sin(e)\cos^2(e)$ |
| 15 | 3 | $\sqrt{\frac{5}{8}}\cos(3\alpha)\cos^3(e)$ |

Figure 2:
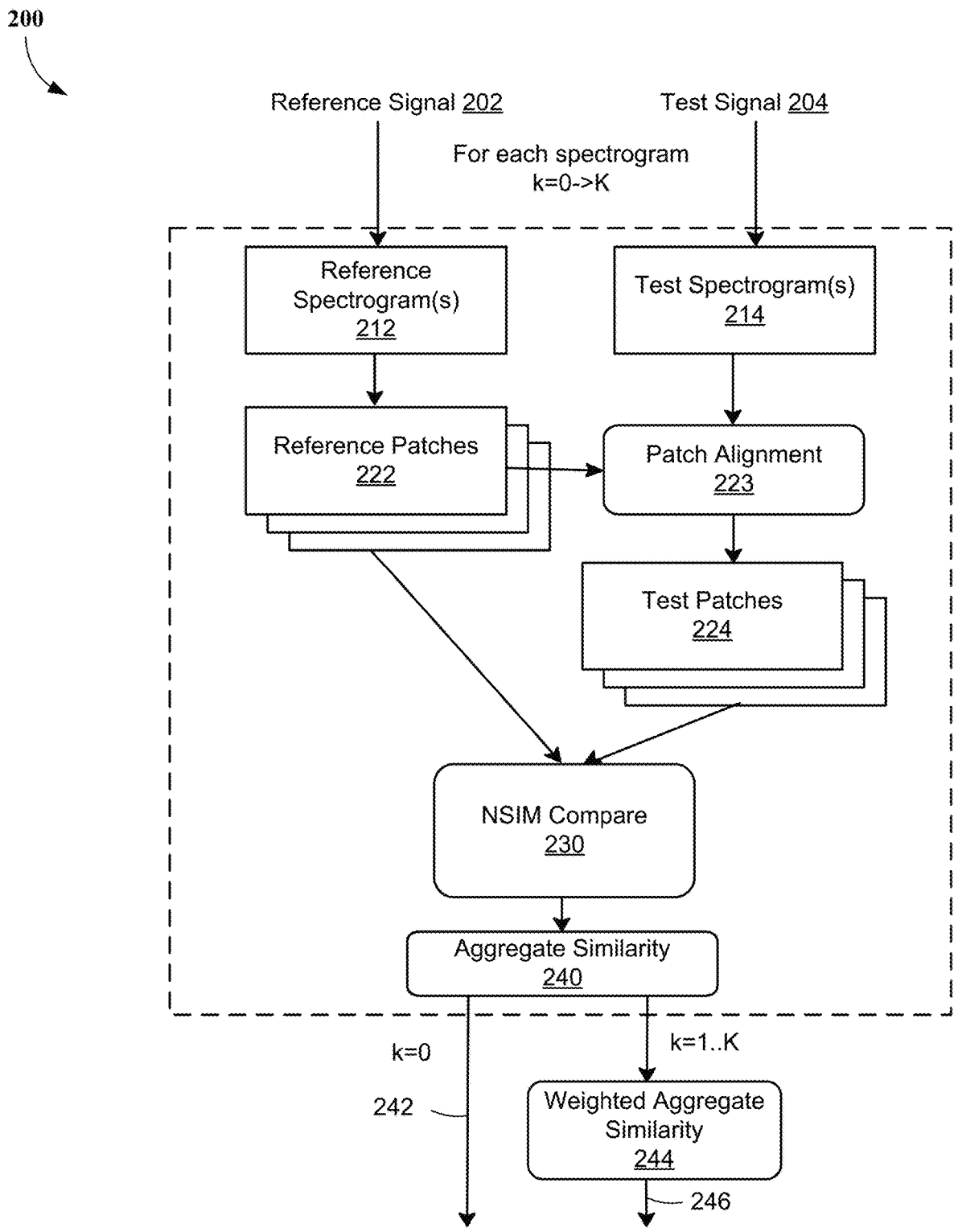
FIG. 2 illustrates a flowchart for determining an objective quality metric for ambisonic spatial audio, according to least one example implementation.

FIG. 2 illustrates a flowchart 200 for determining an objective quality metric for ambisonic spatial audio, according to least one example implementation.

In some implementations, a reference signal 202 and a test signal 204 may be inputs to a computing device (e.g., a computing device 500 of FIG. 5) for executing the process of the flowchart 200. The reference signal 202 and the test signal 204, for example, may be B-format ambisonic signals, which, in one example, may be 10-20 seconds in duration. In one implementation, for example, the reference signal 202 and the test signal 202 may be 3OA signals. The test signal 204 may be extracted (e.g., decoded) from an encoded (or compressed) version of the reference signal 202 so that the QoE may be determined by taking into account signal degradations and any changes to the perceived localization of sound source origins due to the decoding/encoding process.

In one example implementation, the reference signal 202 (e.g., reference ambisonic audio sources) may be rendered to 22 fixed localizations that may be evenly distributed on a quarter of the sphere. The test signal 204 (e.g., test ambisonic audio signals) may be rendered at 206 fixed localizations that may be evenly distributed on the whole sphere (e.g., with 30 horizontal and vertical steps).

At block 212, the computing device may create spectrograms (that may be referred to as reference spectrograms or reference phaseograms) of each channel of the reference signal 202. For example, 16 spectrograms of the reference signal 202 may be created, one spectrogram of each channel of the reference signal 202. At block 214, the computing device may create spectrograms (that may be referred to as test spectrograms or test phaseograms) of each channel of the test signal 204. For example, 16 spectrograms may be created, one spectrogram of each channel of the test signal 204.

In some implementations, the spectrograms of the test signal 202 and the reference signal 204 may be created using short-time Fourier transform (STFT) of their respective ambisonic channels. For instance, a STFT with a 1536-point Hamming window (e.g., 50% overlap) may be applied to the channels of the reference signal 202 and the test signal 204 to generate the spectrograms. In one implementation, for example, the generated spectrograms may be phaseograms (also referred to as phase spectrograms). In a phaseogram, phase values of STFT may be processed and presented graphically such that time-frequency distribution of the phase of a component may provide information about phase modulations around a reference point to determine reference phase and reference frequency for the component. For instance, the STFT may create a spectrogram of real and imaginary numbers for every time/frequency from which the phase of every frequency at any given time may be extracted. In one more implementation, the spectrograms may be generated based on intensities or a combination of phase angles and intensities.

Figure 6:
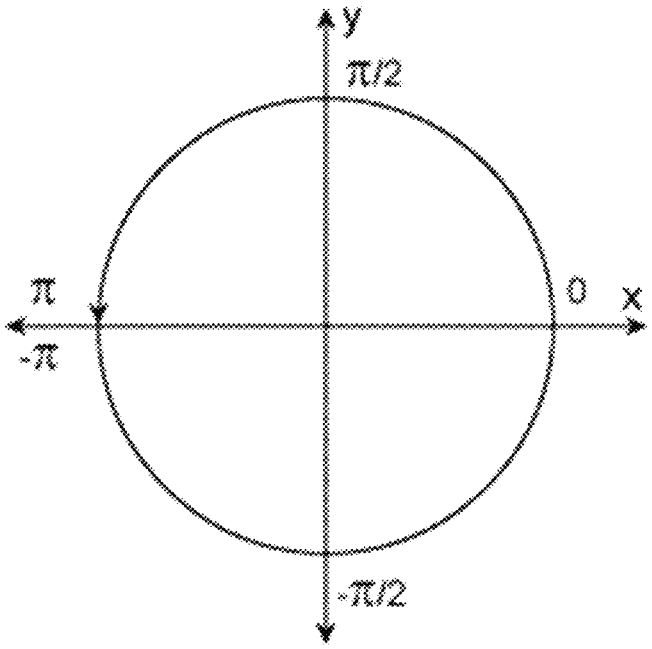
FIG. 6 illustrates a four-quadrant inverse tangent, atan 2(Y,X), that returns values in a closed interval [−pi, pi] based on values of Y and X, according to least one example implementation.

For instance, a spectrogram, z, may be a matrix that is computed using a short-time Fourier transform of an input signal using a 1536-poing Hamming window (e.g., 50% overlap). The matrix may contain real and imaginary components and a phaseogram is a corresponding phase angle matrix of the spectrogram that is computed from the spectrogram using the equation below, $$\text{angle}(z)=\text{imag}(\log(z))=\text{atan 2}(\text{imag}(z),\text{real}(z)),$$

where atan 2 is a four-quadrant inverse tangent, as illustrated by 600 of FIG. 6. For example, atan 2(Y, X) may return values in the closed interval [−pi, pi] based on values of Y and X as shown in FIG. 6.

At block 222, the computing device may segment the reference spectrograms generated at block 212 into patches (that may be referred to as reference patches). That is, one or more reference patches may be created for each channel of the reference signal 202 from the respective reference spectrograms. In some implementations, the computing device may create (or generate) one or more patches from each of the reference spectrograms. A reference patch may be generated from a portion of the reference signal 202, for example, 0.5 seconds long and may be created using STFT. In one implementation, for example, a reference patch may be a 30×32 matrix (e.g., 32 frequency bands x 30 time frames). The references patches may be used for comparing with corresponding patches generated from the test signal 204 to compute similarity scores to determine Listening Quality and/or Localization Accuracy.

At block 224, the computing device may segment the test spectrograms generated at block 214 into patches (may be referred to as test patches). That is, one or more test patches may be created for each channel of the test signal 204 from the respective test spectrograms. In some implementations, the computing device may create (or generate) one or more patches from each of the test spectrograms. Similar to the reference patches, a test patch may be, for example, 0.5 seconds long and may be created using STFT. In one implementation, for example, a test patch may be a 30×32 matrix (e.g., 32 frequency bands x 30 time frames). The test patches may be used for comparing with the corresponding reference patches to compute similarity scores to determine Listening Quality and/or Localization Accuracy.

In some implementations, at block 223, the test patches and the reference patches may be aligned with each other. The alignment (e.g., time alignment) may be performed, prior to comparing of the reference and test patches, to ensure that a reference patch is being compared with a corresponding test patch that is most similar. In other words, the alignment may be performed to time-align the patches prior to the comparison.

At block 230, the computing device may compare reference patches with test patches. In some implementations, the comparing may be performed using NSIM which may compare patches across all frequency bands and compute aggregate similarity scores at block 240. As described above, NSIM is a similarity measure for comparing spectrograms of reference patches and test patches to compute similarity scores. In one implementation, for example, the comparison may be based on phase angles and NSIM may compare the phases in each of the points in the 30×32 matrices (associated with the reference and test patches) and compute the average value to generate the NSIM values.

In some implementations, at 242, the Listening Quality may be determined based on an aggregate score of channel 0 based on the comparing of one or more patches of channel 0 (e.g., k=0). That is, the Listening Quality may be determined based on aggregate similarity scores of channel 0, the omni-directional channel 110. The omni-directional channel 110 is considered to contain a composite of directional channels and the content of the omni-directional channel 10 may be considered to be a good (e.g., representative) indicator of the Listening Quality (e.g., due to encoding artefacts and without localization differences). In one implementation, for example, the Listening Quality (LQ) may be computed by applying a ViSQOLAudio algorithm to the phaseograms of channel 0 (e.g., k=0) of the reference signal 202 (*r*) and the test signal 204 (*t*) as shown in the following equation, $$LQ=V(r_0,t_0),$$

where LQ is the listening quality, V is ViSQOLAudio algorithm, $r_0$ is the reference phaseograms of channel 0, and $t_0$ is the test phaseograms of channel 0.

For example, the LQ may be computed using ViSQOLAudio model (described above) that measures similarity scores using NSIM for patches of channel 0.

In some implementations, the LQ scores may have values between 0 and 1, with a value of I being a perfect match. That is, a test patch matches perfectly with a corresponding reference patch.

In some implementations, at 244, the Localization Accuracy (LA) may be determined based on aggregate similarity scores of channels 1 to K (e.g., channels 1 to 15 for 3OA). That is, the similarity scores of channels 1-15 are computed and aggregated to determine the aggregate similarity score. However, in one implementation, for example, the LA may be determined as a weighted sum of similarity between the reference and test channels. That is, different weights may be assigned to the various directional components of channels 1-15.

For instance, the channels (e.g., 1-15) may be grouped into vertical-only channels and mixed direction channels. For 3OA, channels 2, 6, and 12 are vertical-only channels. For higher order ambisonics, the vertical-only channels may be determined as shown below:

$$k_{vertical}(n)=n(n+1)$$

The LA may be computed as a weighted sum of similarity between reference patch, r, and test patch, t, as shown in the following equation, $$LA = \frac{\alpha}{N_{vert}} \sum_{k_{vert}} V(r_k, t_k) + \frac{(1-\alpha)}{N_{mixed}} \sum_{k_{mixed}} V(r_k, t_k),$$

where LA is the listening quality, V is ViSQOLAudio algorithm, alpha (α) is a parameter that controls trade-off between vertical and horizontal components, $r_k$ is the reference phaseogram of vertical component channel k, $t_k$ is the test phaseogram of vertical component channel k, $r_k$ is the reference phaseogram of mixed component channel k, and $t_k$ is the test phaseogram of mixed component channel k.

For example, the LA may be computed using the ViSQOLAudio model (described above) that measures NSIM similarity scores, for example, for channels 1-15 for third order ambisonics. In some implementations, the value of alpha (α) may control a trade-off between the importance of vertical and horizontal components (e.g., control bias). That is, the higher the value of a, the more emphasis may be given to vertical channel similarity (vs horizontal channel similarity). Thus, as described above, the Listening Quality and/or the Localization Accuracy of ambisonic spatial audio may be determined by computing aggregate similarity scores of channel 0 and channels 1-15, respectively, of the ambisonic spatial audio. In some other implementations, the value of alpha may be channel dependent. In other words, different channels may have different alpha values to control the trade-off between the importance of vertical and horizontal components on a per-channel basis and/or the value of alpha may change depending on the ambisonic order.

Figure 3:
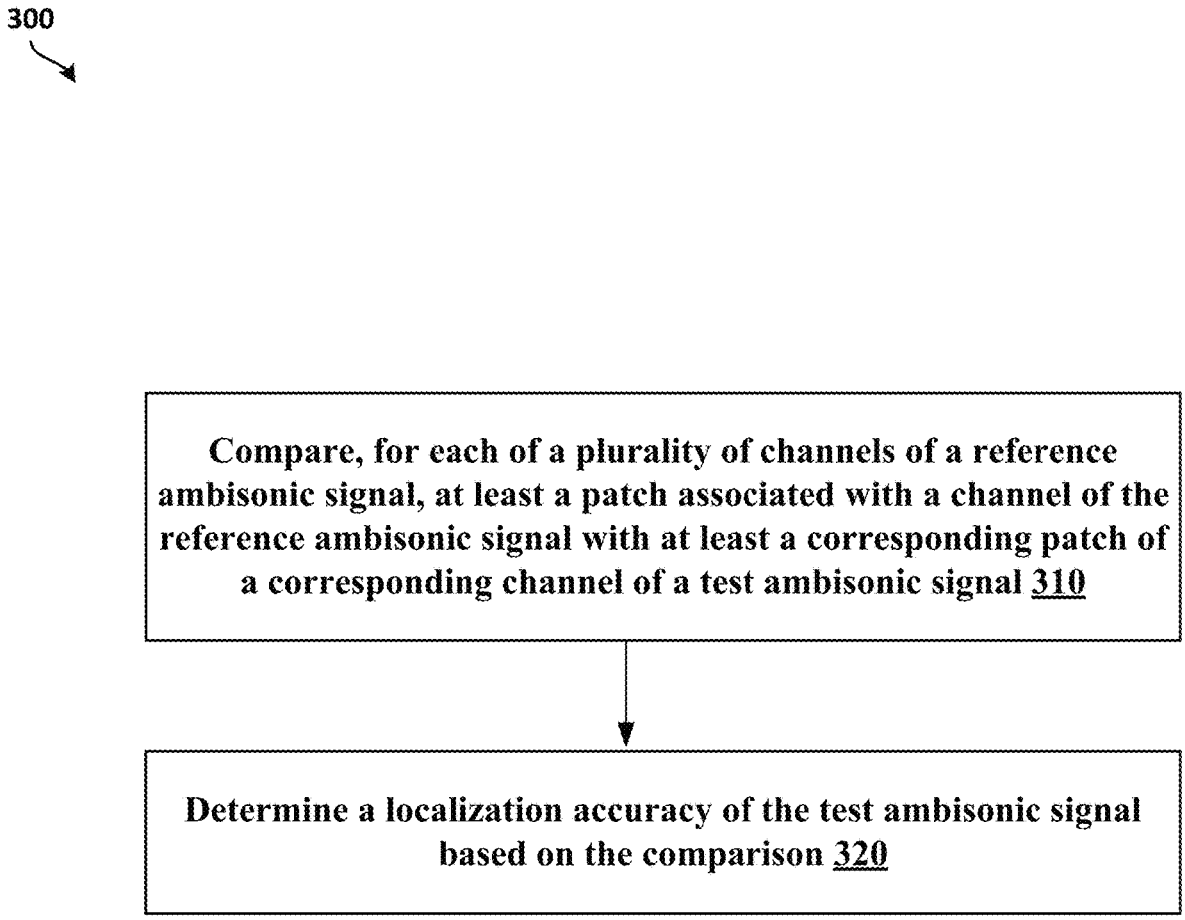
FIG. 3 illustrates a flowchart of a method for determining listening quality and localization accuracy of ambisonics spatial audio, according to least one example implementation.

FIG. 3 illustrates a flowchart 300 of a method of determining quality of experience (QoE) of ambisonics spatial audio according to least one example implementation.

At block 310, a computing device may compare at least a patch associated with a channel of the reference ambisonic signal with at least a corresponding patch of a corresponding channel of a test ambisonic signal. The comparison may be performed for each of a plurality of channels of reference and test ambisonic signals. In some implementations, the test ambisonic signal may be generated by decoding an encoded version of the reference ambisonic signal and the comparison may be based on phaseograms of the reference ambisonic signal and the test ambisonic signal. For example, the computing device may compare at least one patch associated with each channel of the reference signal 202 with at least the corresponding patch of the test signal 204. For instance, the computing device may compare patch 1 of channel 0 of the reference signal 202 with patch 1 of channel 0 of the test signal 204. In another instance, the computing device may compare patch 1 of channel 1 of the reference signal 202 with patch 1 of channel 1 of the test signal 204, and so on.

At block 320, the computing device may determine a localization accuracy of the test ambisonic signal based on the comparison. The comparison may be performed using NSIM, as described above in reference to FIG. 2, to generate similarity scores. In one implementation for example, the computing device may determine the listening quality may be based on an aggregate score that is based on comparing of the omni-directional components (or channels) of the reference signal and the test signal. In one more implementation, for example, the computing device may determine the localization accuracy based on a weighted sum of similarity scores between corresponding multi-directional channels (e.g., channels 1-15) of the test and reference signals. Thus, the listening quality and/or localization accuracy of an ambisonic spatial audio are determined.

Figure 4:
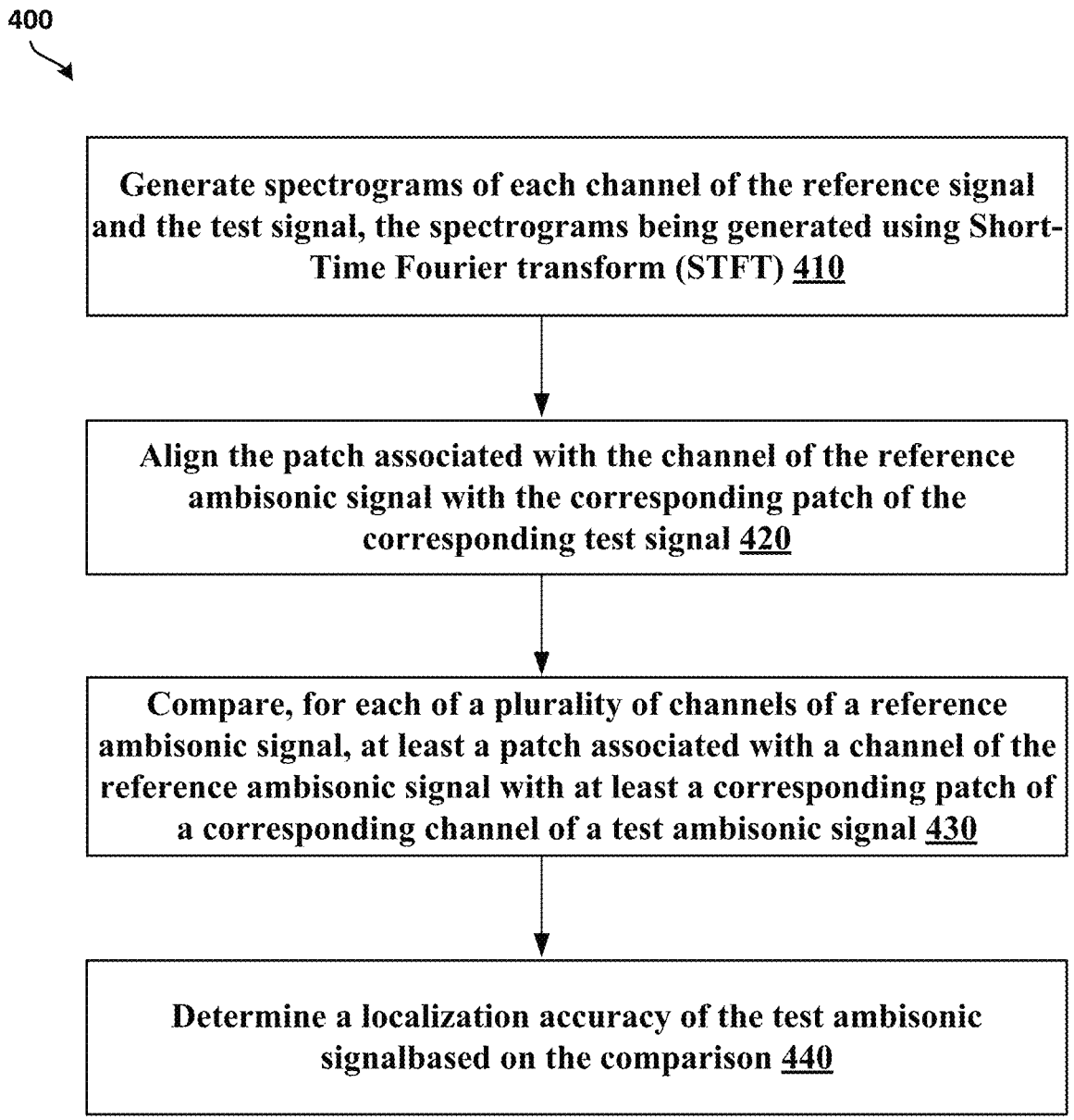
FIG. 4 illustrates a flowchart of a method for determining listening quality and localization accuracy of ambisonics spatial audio, according to least another example implementation.

FIG. 4 illustrates a flowchart 400 of a method of determining quality of experience (QoE) of ambisonics spatial audio, according to least another example implementation.

At block 410, a computing device may generate phaseograms of the plurality of channels of the reference ambisonic signal and the test ambisonic signal. In some implementations, the computing device may generate phaseograms of the plurality of channels of the reference ambisonic signal 202 and test ambisonic signal 204, as described above in reference to FIG. 2. The phaseograms may be created using STFT.

At block 420, the computing device may align, prior to comparing, the patch associated with the channel of the reference ambisonic signal with the corresponding patch of the corresponding channel of the test ambisonic signal. In some implementations, the computing device may align corresponding patches with each other prior to comparison to provide for the patches with the best match to be compared with each other.

At block 430, the operations are similar to operations at block 310 of FIG. 3.

At block 440, the operations are similar to operations at block 320 of FIG. 3.

Thus, the listening quality and/or localization accuracy of an ambisonic spatial audio are determined.

Figure 5:
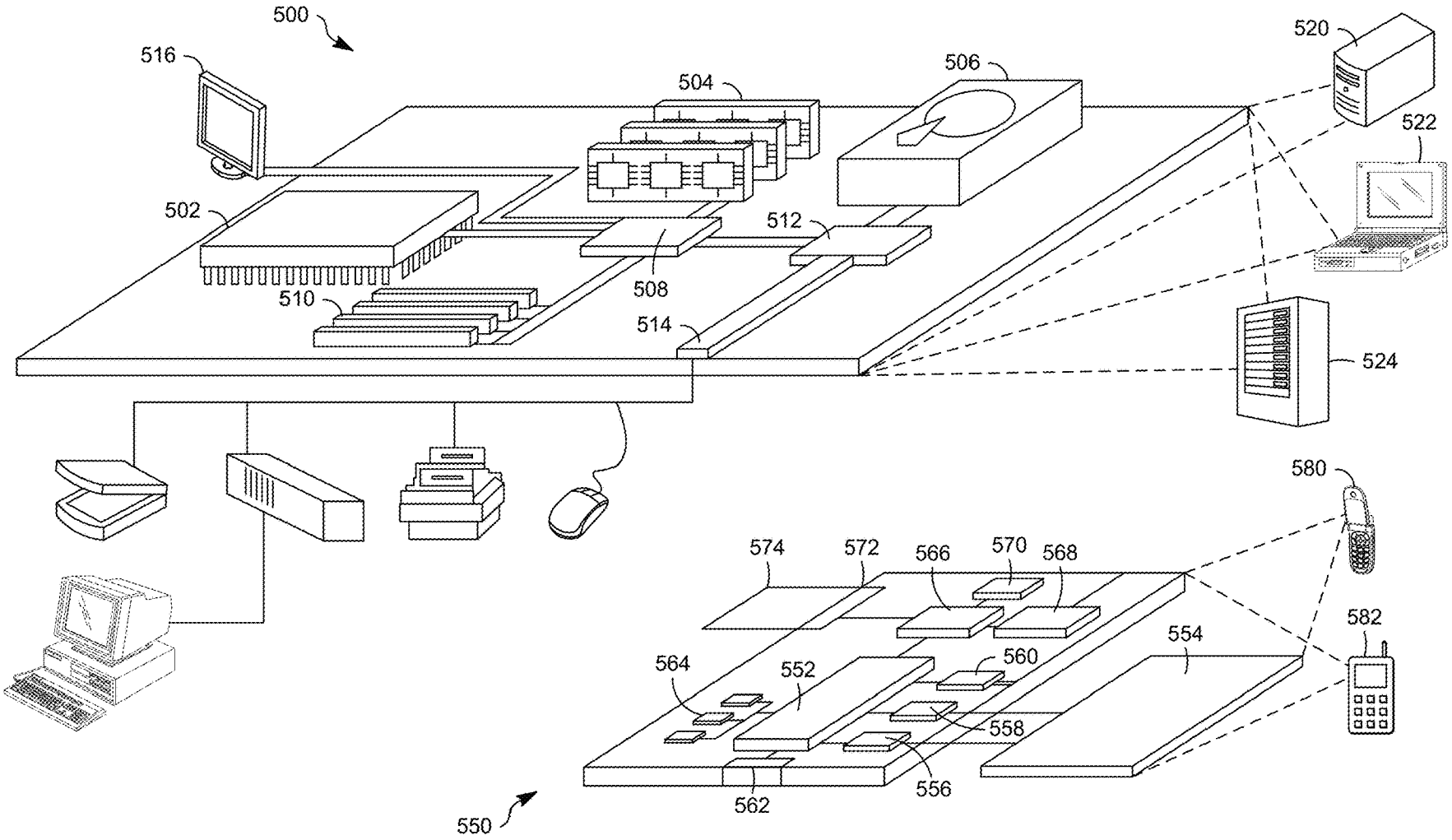
FIG. 5 shows an example of a computer device and a mobile computer device, which may be used with the techniques described here according to least one example implementation.

FIG. 5 shows an example of a computer device 500 and a mobile computer device 550, which may be used with the techniques described here. Computing device 500 is intended to represent various forms of digital computers, such as laptops, desktops, workstations, personal digital assistants, servers, blade servers, mainframes, and other appropriate computers. Computing device 550 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device 500 includes a processor 502, memory 504, a storage device 506, a high-speed interface 508 connecting to memory 504 and high-speed expansion ports 510, and a low speed interface 512 connecting to low speed bus 514 and storage device 506. Each of the components 502, 504, 506, 508, 510, and 512, are interconnected using various busses, and may be mounted on a common motherboard or in other manners as appropriate. The processor 502 can process instructions for execution within the computing device 500, including instructions stored in the memory 504 or on the storage device 506 to display graphical information for a GUI on an external input/output device, such as display 516 coupled to high speed interface 508. In other implementations, multiple processors and/or multiple buses may be used, as appropriate, along with multiple memories and types of memory. Also, multiple computing devices 500 may be connected, with each device providing portions of the necessary operations (e.g., as a server bank, a group of blade servers, or a multi-processor system).

The memory 504 stores information within the computing device 500. In one implementation, the memory 504 is a volatile memory unit or units. In another implementation, the memory 504 is a non-volatile memory unit or units. The memory 504 may also be another form of computer-readable medium, such as a magnetic or optical disk.

The storage device 506 is capable of providing mass storage for the computing device 500. In one implementation, the storage device 506 may be or contain a computer-readable medium, such as a floppy disk device, a hard disk device, an optical disk device, or a tape device, a flash memory or other similar solid state memory device, or an array of devices, including devices in a storage area network or other configurations. The computer program product can be tangibly embodied in an information carrier. The computer program product may also contain instructions that, when executed, perform one or more methods, such as those described above. The information carrier is a computer- or machine-readable medium, such as the memory 504, the storage device 506, or memory on processor 502.

The high speed controller 508 manages bandwidth-intensive operations for the computing device 500, while the low speed controller 512 manages lower bandwidth-intensive operations. Such allocation of functions is exemplary only. In one implementation, the high-speed controller 508 is coupled to memory 504, display 516 (e.g., through a graphics processor or accelerator), and to high-speed expansion ports 510, which may accept various expansion cards (not shown). In the implementation, low-speed controller 512 is coupled to storage device 506 and low-speed expansion port 514. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 500 may be implemented in a number of different forms, as shown in the figure. For example, it may be implemented as a standard server 520, or multiple times in a group of such servers. It may also be implemented as part of a rack server system 524. In addition, it may be implemented in a personal computer such as a laptop computer 522. Alternatively, components from computing device 500 may be combined with other components in a mobile device (not shown), such as device 550. Each of such devices may contain one or more of computing device 500, 550, and an entire system may be made up of multiple computing devices 500, 550 communicating with each other.

Computing device 550 includes a processor 552, memory 564, an input/output device such as a display 554, a communication interface 566, and a transceiver 568, among other components. The device 550 may also be provided with a storage device, such as a microdrive or other device, to provide additional storage. Each of the components 550, 552, 564, 554, 566, and 568, are interconnected using various buses, and several of the components may be mounted on a common motherboard or in other manners as appropriate.

The processor 552 can execute instructions within the computing device 550, including instructions stored in the memory 564. The processor may be implemented as a chipset of chips that include separate and multiple analog and digital processors. The processor may provide, for example, for coordination of the other components of the device 550, such as control of user interfaces, applications run by device 550, and wireless communication by device 550.

Processor 552 may communicate with a user through control interface 558 and display interface 556 coupled to a display 554. The display 554 may be, for example, a TFT LCD (Thin-Film-Transistor Liquid Crystal Display) or an OLED (Organic Light Emitting Diode) display, or other appropriate display technology. The display interface 556 may comprise appropriate circuitry for driving the display 554 to present graphical and other information to a user. The control interface 558 may receive commands from a user and convert them for submission to the processor 552. In addition, an external interface 562 may be provide in communication with processor 552, to enable near area communication of device 550 with other devices. External interface 562 may provide, for example, for wired communication in some implementations, or for wireless communication in other implementations, and multiple interfaces may also be used.

The memory 564 stores information within the computing device 550. The memory 564 can be implemented as one or more of a computer-readable medium or media, a volatile memory unit or units, or a non-volatile memory unit or units. Expansion memory 574 may also be provided and connected to device 550 through expansion interface 572, which may include, for example, a SIMM (Single In Line Memory Module) card interface. Such expansion memory 574 may provide extra storage space for device 550, or may also store applications or other information for device 550. Specifically, expansion memory 574 may include instructions to carry out or supplement the processes described above, and may include secure information also. Thus, for example, expansion memory 574 may be provide as a security module for device 550, and may be programmed with instructions that permit secure use of device 550. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 564, expansion memory 574, or memory on processor 552, that may be received, for example, over transceiver 568 or external interface 562.

Device 550 may communicate wirelessly through communication interface 566, which may include digital signal processing circuitry where necessary. Communication interface 566 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 568. In addition, short-range communication may occur, such as using a Bluetooth, Wi-Fi, or other such transceiver (not shown). In addition, GPS (Global Positioning System) receiver module 570 may provide additional navigation- and location-related wireless data to device 550, which may be used as appropriate by applications running on device 550.

Device 550 may also communicate audibly using audio codec 560, which may receive spoken information from a user and convert it to usable digital information. Audio codec 560 may likewise generate audible sound for a user, such as through a speaker, e.g., in a handset of device 550. Such sound may include sound from voice telephone calls, may include recorded sound (e.g., voice messages, music files, etc.) and may also include sound generated by applications operating on device 550.

The computing device 550 may be implemented in a number of different forms, as shown in the figure. For example, it may be implemented as a cellular telephone 580. It may also be implemented as part of a smart phone 582, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device. Various implementations of the systems and techniques described here can be realized as and/or generally be referred to herein as a circuit, a module, a block, or a system that can combine software and hardware aspects. For example, a module may include the functions/acts/computer program instructions executing on a processor (e.g., a processor formed on a silicon substrate, a GaAs substrate, and the like) or some other programmable data processing apparatus.

Some of the above example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed above, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks may be stored in a machine or computer readable medium such as a storage medium. A processor(s) may perform the necessary tasks.

Specific structural and functional details disclosed herein are merely representative for purposes of describing example embodiments. Example embodiments, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term and/or includes any and all combinations of one or more of the associated listed items.

It will be understood that when an element is referred to as being connected or coupled to another element, it can be directly connected or coupled to the other element or intervening elements may be present. In contrast, when an element is referred to as being directly connected or directly coupled to another element, there are no intervening elements present. Other words used to describe the relationship between elements should be interpreted in a like fashion (e.g., between versus directly between, adjacent versus directly adjacent, etc.).

The terminology used herein is for the purpose of describing particular embodiments only and is not intended to be limiting of example embodiments. As used herein, the singular forms a, an, and the are intended to include the plural forms as well, unless the context clearly indicates otherwise. It will be further understood that the terms comprises, comprising, includes and/or including, when used herein, specify the presence of stated features, integers, steps, operations, elements and/or components, but do not preclude the presence or addition of one or more other features, integers, steps, operations, elements, components and/or groups thereof.

It should also be noted that in some alternative implementations, the functions/acts noted may occur out of the order noted in the figures. For example, two figures shown in succession may in fact be executed concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the above example implementations and corresponding detailed description are presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the above illustrative implementations, reference to acts and symbolic representations of operations (e.g., in the form of flowcharts) that may be implemented as program modules or functional processes include routines, programs, objects, components, data structures, etc., that perform particular tasks or implement particular abstract data types and may be described and/or implemented using existing hardware at existing structural elements. Such existing hardware may include one or more Central Processing Units (CPUs), digital signal processors (DSPs), application-specific-integrated-circuits, field programmable gate arrays (FPGAs) computers or the like.

It should be borne in mind, however, that all of these and similar terms are to be associated with the appropriate physical quantities and are merely convenient labels applied to these quantities. Unless specifically stated otherwise, or as is apparent from the discussion, terms such as processing or computing or calculating or determining of displaying or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Note also that the software implemented aspects of the example implementations are typically encoded on some form of non-transitory program storage medium or implemented over some type of transmission medium. The program storage medium may be magnetic (e.g., a floppy disk or a hard drive) or optical (e.g., a compact disk read only memory, or CD ROM), and may be read only or random access. Similarly, the transmission medium may be twisted wire pairs, coaxial cable, optical fiber, or some other suitable transmission medium known to the art. The example implementations not limited by these aspects of any given implementation.

Lastly, it should also be noted that whilst the accompanying claims set out particular combinations of features described herein, the scope of the present disclosure is not limited to the particular combinations hereafter claimed, but instead extends to encompass any combination of features or implementations herein disclosed irrespective of whether or not that particular combination has been specifically enumerated in the accompanying claims at this time.

While example implementations may include various modifications and alternative forms, implementations thereof are shown by way of example in the drawings and will herein be described in detail. It should be understood, however, that there is no intent to limit example implementations to the particular forms disclosed, but on the contrary, example implementations are to cover all modifications, equivalents, and alternatives falling within the scope of the claims. Like numbers refer to like elements throughout the description of the figures.

What is claimed is:

1. A computer-implemented method of determining quality of experience (QoE) of ambisonic spatial audio signals, comprising:

comparing, for each of a plurality of channels of a reference ambisonic signal, at least a patch associated with a channel of the reference ambisonic signal with at least a corresponding patch of a corresponding channel of a test ambisonic signal, the test ambisonic signal generated by decoding an encoded version of the reference ambisonic signal; and determining a localization accuracy of the test ambisonic signal based on the comparison.

2. The method of claim 1, further comprising:

aligning, prior to the comparing, the patch associated with the channel of the reference ambisonic signal with the corresponding patch of the corresponding channel of the test ambisonic signal.

3. The method of claim 1, wherein the comparing is based, at least in part, on spectrograms, phaseograms, or a combination thereof, of the reference ambisonic signal and the test ambisonic signal.

4. The method of claim 1, further comprising:

generating spectrograms of the plurality of channels of the reference ambisonic signal and the test ambisonic signal, the spectrograms generated using short-time Fourier transform (STFT).

5. The method of claim 1, further comprising:

determining a listening quality of the test ambisonic signal based on the comparison.

6. The method of claim 5, wherein the comparing is based on a neurogram similarity index measure (NSIM), wherein the comparing further comprises comparing a patch associated with an omni-directional channel of the reference ambisonic signal with a corresponding patch of an omni-directional channel of the test ambisonic signal, and wherein the determining the listening quality further comprises determining an aggregated similarity score based on the comparing of the omni-directional channel of the reference ambisonic signal and the omni-directional channel of the test ambisonic signal.

7. The method of claim 1, herein the comparing is based on a neurogram similarity index measure (NSIM), wherein the comparing further comprises comparing a patch associated with each multi-directional channel of the reference ambisonic signal with a corresponding patch of a corresponding multi-directional channel of the test ambisonic signal, and wherein the determining the localization accuracy further comprises determining an aggregated similarity score that is based on weighted sum of similarity scores between corresponding multi-directional channels of the test ambisonic signal and the reference ambisonic signal.

8. The method of claim 7, further comprising:

assigning different weights to vertical and horizontal components of the multi-directional channels.

9. A computing device for determining quality of experience (QoE) of Ambisonic spatial audio signals, comprising:

a processor; and a memory, the memory including instructions configured to cause the processor to:

compare, for each of a plurality of channels of a reference ambisonic signal, at least a patch associated with a channel of the reference ambisonic signal with at least a corresponding patch of a corresponding channel of a test ambisonic signal, the test ambisonic signal generated by decoding an encoded version of the reference ambisonic signal; and determine a localization accuracy of the test ambisonic signal based on the comparison.

10. The computing device of claim 9, wherein the processor is further configured to:

align, prior to the comparing, the patch associated with the channel of the reference ambisonic signal with the corresponding patch of the corresponding channel of the test ambisonic signal.

11. The computing device of claim 9, wherein the processor is further configured to:

compare based, at least in part, on spectrograms, phaseograms, or a combination thereof, of the reference ambisonic signal and the test ambisonic signal.

12. The computing device of claim 9, wherein the processor is further configured to:

determine a listening quality of the test ambisonic signal based on the comparison.

13. The computing device of claim 12, wherein the comparison is based on a neurogram similarity index measure (NSIM), and wherein the processor is further configured to:

compare a patch associated with an omni-directional channel of the reference ambisonic signal with a corresponding patch of an omni-directional channel of the test ambisonic signal, and determine the listening quality further comprises determining an aggregated similarity score based on the comparing of the omni-directional channel of the reference ambisonic signal and the omni-directional channel of the test ambisonic signal.

14. The computing device of claim 9, wherein the comparing is based on a neurogram similarity index measure (NSIM), wherein the processor is further configured to:

compare a patch associated with each multi-directional channel of the reference ambisonic signal with a corresponding patch of a corresponding multi-directional channel of the test ambisonic signal, and determine the localization accuracy further comprises determining an aggregated similarity score that is based on weighted sum of similarity scores between corresponding multi-directional channels of the test ambisonic signal and the reference ambisonic signal.

15. A non-transitory computer-readable storage medium having stored thereon computer executable program code which, when executed on a computer system, causes the computer system to perform a method of determining quality of experience (QoE) of ambisonic spatial audio signals comprising:

comparing, for each of a plurality of channels of a reference ambisonic signal, at least a patch associated with a channel of the reference ambisonic signal with at least a corresponding patch of a corresponding channel of a test ambisonic signal, the test ambisonic signal generated by decoding an encoded version of the reference ambisonic signal; and determining a localization accuracy of the test ambisonic signal based on the comparison.

16. The computer-readable storage medium of claim 15, further comprising code for:

aligning, prior to the comparing, the patch associated with the channel of the reference ambisonic signal with the corresponding patch of the corresponding channel of the test ambisonic signal.

17. The computer-readable storage medium of claim 15, further comprising code for:

comparing being based, at least in part, on spectrograms, phaseograms, or a combination thereof, of the reference ambisonic signal and the test ambisonic signal, generating spectrograms of the plurality of channels of the reference ambisonic signal and the test ambisonic signal, the spectrograms generated using short-time Fourier transform (STFT).

18. The computer-readable storage medium of claim 15, further comprising code for:

determining a listening quality of the test ambisonic signal based on the comparison.

19. The computer-readable storage medium of claim 18, wherein the comparing is based on a neurogram similarity index measure (NSIM), wherein the comparing further comprises comparing a patch associated with an omni-directional channel of the reference ambisonic signal with a corresponding patch of an omni-directional channel of the test ambisonic signal, and wherein the determining the listening quality further comprises determining an aggregated similarity score based on the comparing of the omni-directional channel of the reference ambisonic signal and the omni-directional channel of the test ambisonic signal.

20. The computer-readable storage medium of claim 15, wherein the comparing is based on a neurogram similarity index measure (NSIM), wherein the comparing further comprises comparing a patch associated with each multi-directional channel of the reference ambisonic signal with a corresponding patch of a corresponding multi-directional channel of the test ambisonic signal, and wherein the determining the localization accuracy further comprises determining an aggregated similarity score that is based on weighted sum of similarity scores between corresponding multi-directional channels of the test ambisonic signal and the reference ambisonic signal.

* * * * *